US005672000A

United States Patent [19]

Lin

[11] Patent Number: 5,672,000

[45] Date of Patent: Sep. 30, 1997

[54] DECORATIVE LAMP STRIP

[76] Inventor: Tayeh Lin, 3rd Floor, No. 16, Chung Yang S. Road, Sec. 2, Peitou District, Taipei City, Taiwan

[21] Appl. No.: 305,723

[22] Filed: Sep. 14, 1994

[51] Int. Cl.[6] ..... F21V 21/34

[52] U.S. Cl. ..... 362/249; 362/226; 362/241; 362/391; 362/806; 439/419

[58] Field of Search ..... 439/414, 419; 362/226, 227, 241, 247, 249, 391, 800, 806

[56] References Cited

U.S. PATENT DOCUMENTS

| | | | |
|---|---|---|---|
| 4,159,157 | 6/1979 | Koehler | 439/419 |
| 4,779,177 | 10/1988 | Ahroni | 362/249 |
| 5,339,232 | 8/1994 | Lin | 362/226 |
| 5,366,386 | 11/1994 | Liao | 439/419 |

*Primary Examiner*—Alan Cariaso

[57] ABSTRACT

An improved decorative lamp strip comprising a three-strand flat electric wire, some main sets, some fixing plates, some sets of series connected conductive piece, some sets of a first parallel connected conductive piece, some sets of a second parallel connected conductive piece, some lamp seats and some bulbs with tungsten filament in general or some LED bulbs, wherein the falt electric wire comprises a middle strand series connected conductor and an upper and a lower strand parallel connected conductors, a plurality of holes are punched on the electric wire body, and each punched hole breaks the middle strand conductor, each main seat is installed in the position of each punched hole on the flat electric wire to engage with a fixing plate, and to let any one set of conductive piece installed on the main seat thrust into the middle, upper or lower strand conductor of the flat electric wire so as to combine a decorative lamp strip.

5 Claims, 5 Drawing Sheets

DECORATIVE LAMP STRIP

BACKGROUND OF THE INVENTION

Nowadays the decorative lamp strip includes two types: a decorative lamp strip with tungsten filament bulb in general and a decorative lamp strip with LED (light emitting diode) bulb, but these two-type decorative lamp strips can not be jointly used and thus tend to cause inconvenience of the consumers and users for their use or choice. Next, most of the present available decorative lamp strips in general have no reflecting cover or can not be attached with the reflecting cover, so they can not meet with the demand of consumers and users for a brighter or farther illuminating distance. In addition, so far as the decorative lamp strips made by some manufacturers are concerned, the bulbs together with the 3-strand electric wires are wrapped in a solid plastic strip, their manufacture and assembly are quite troublesome, and once the bulbs are burnt or damaged, they can not be replaced with new once and will have to be scrapped; this is their largest drawback.

SUMMARY OF THE INVENTION

The object of the present invention is to offer an improved decorative lamp strip which is suitable to install tungsten filament bulb in general or LED bulb and convenient to replace the burst or damaged bulbs with new ones.

Another object of the present invention is to offer an improved decorative lamp strip which can be conveniently attached with the reflecting cover so as to enhance the bulb brightness and the illuminating distance.

DETAILED DESCRIPTION

Figure 1:
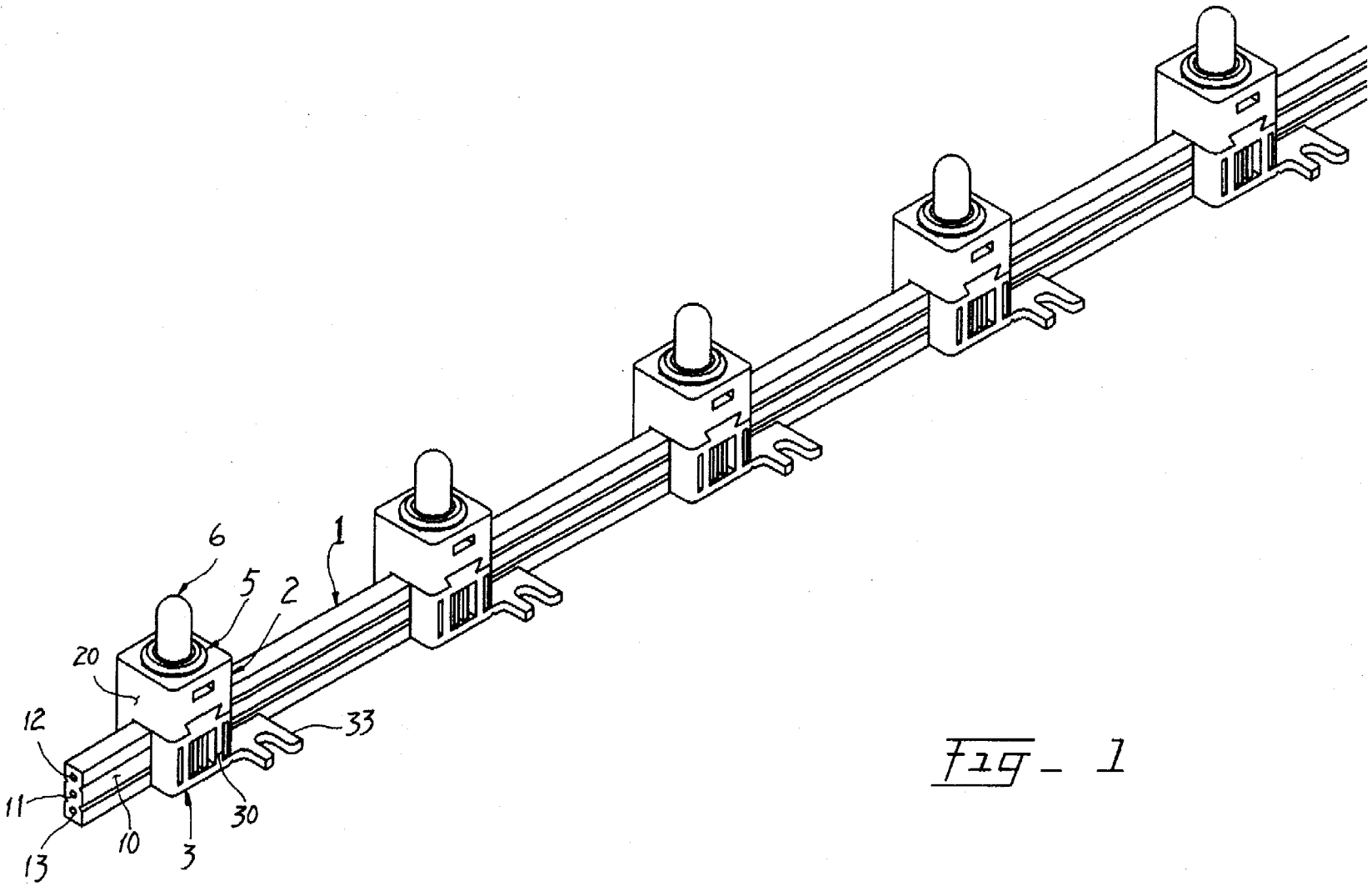
FIG. 1 is an elevational view of the present invention.
Figure 3:
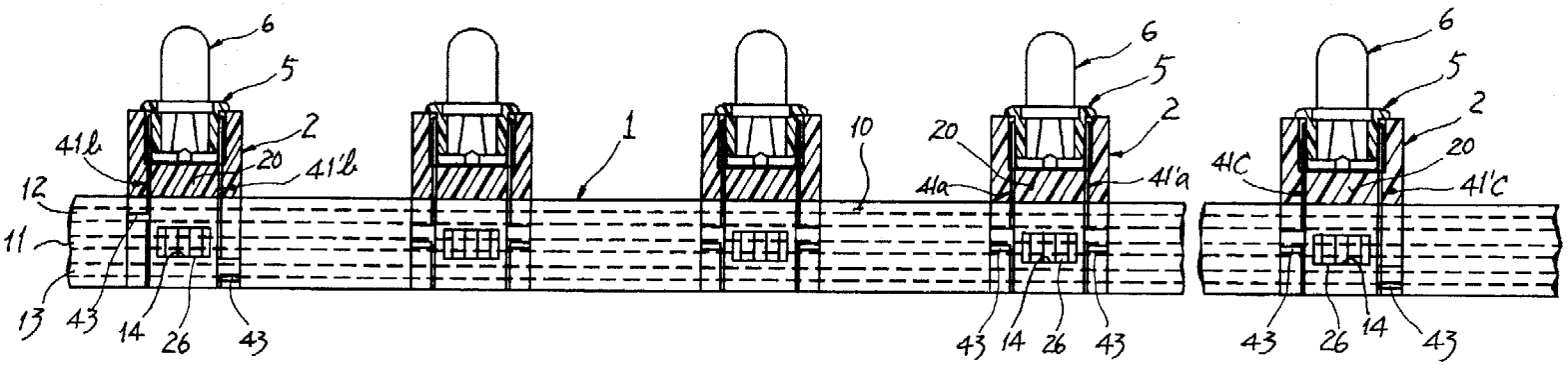
FIG. 3 is a longitudinal sectional view on the line 3-3' of FIG. 1.
Figure 7:
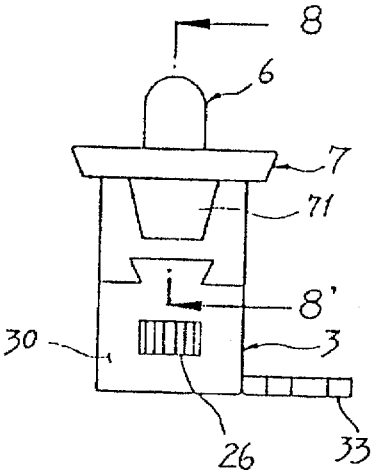
FIG. 7 is an enlarged front schema of the present invention attached with a reflecting cover.
Figure 8:
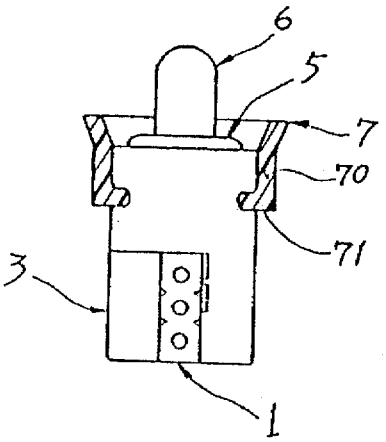
FIG. 8 is a partial sectional view of reflecting cover on the line 8-8' of FIG. 7.
Figure 5:
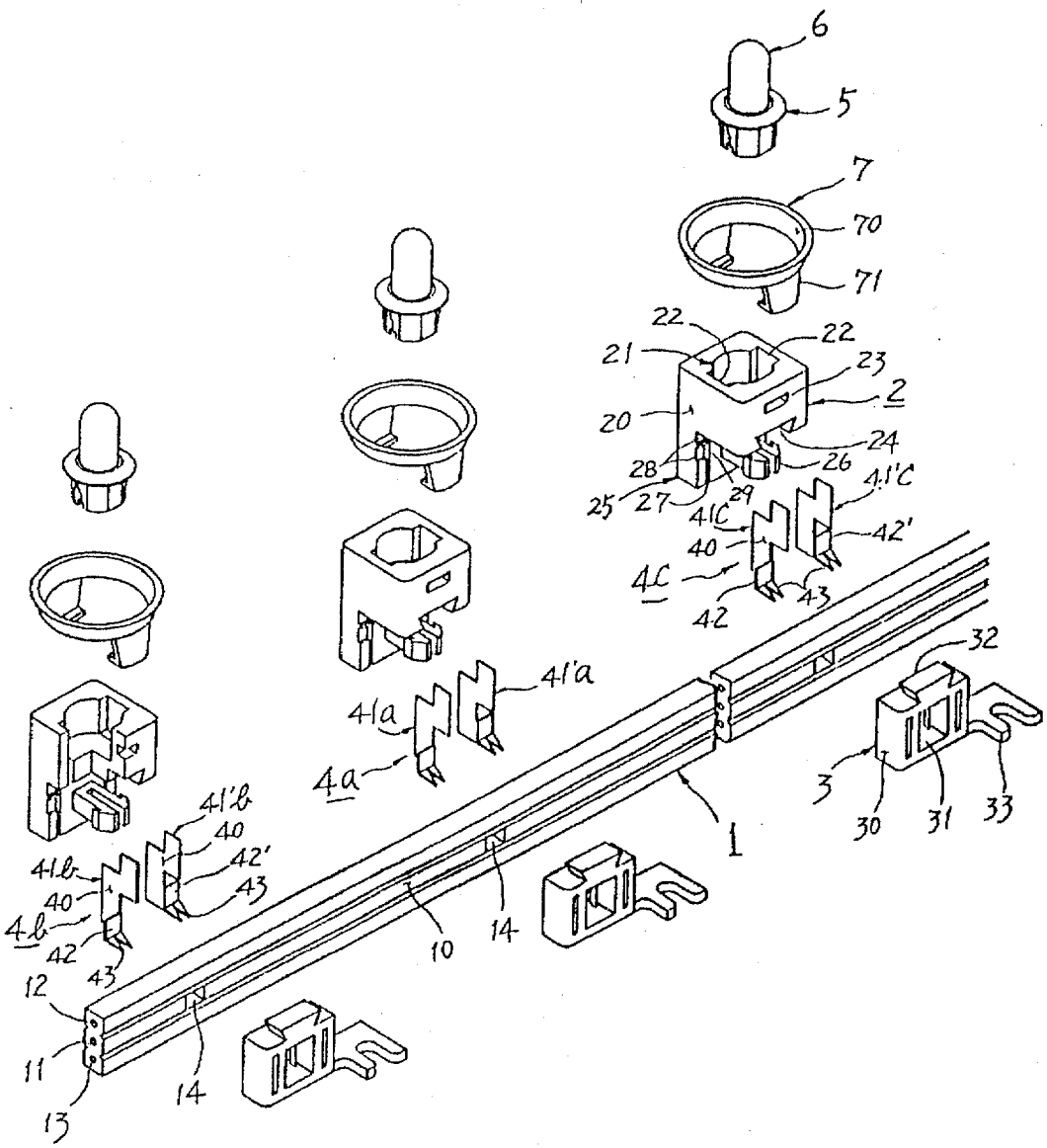
FIG. 5 is an elevational breakdown view of the present invention.

As shown in FIG. 1, 3 and 5, an improved decorative lamp strip of the present invention consists of a flat electric wire 1, some main seats 2, some fixing plates 3, some sets of series connected conductive piece 4*a*, some sets of a first parallel connected conductive piece 4*b*, some sets of a second parallel connected conductive piece 4*c*, some lamp seats 5 and some bulbs 6, or a reflecting cover 7 on each main seat 2 (as shown in FIG. 7 and 8) whereon a lamp seat 5 and a bulb 6 are installed.

The structures of various members of the present invention and the installation manner thereof are described in detail hereinafter in conjunction with FIG. 5.

The flat electric wire 1 comprises a three-strand electric wire, i.e. a middle strand series connected conductor 11 and an upper strand and a lower strand parallel connected conductors 12, 13, and a square hole 14 is punched in the position on the electric wire body 10 for installing a bulb 6. When puncing the hole 14, the middle strand series connected conductor 11 is punched broken.

Figure 4:
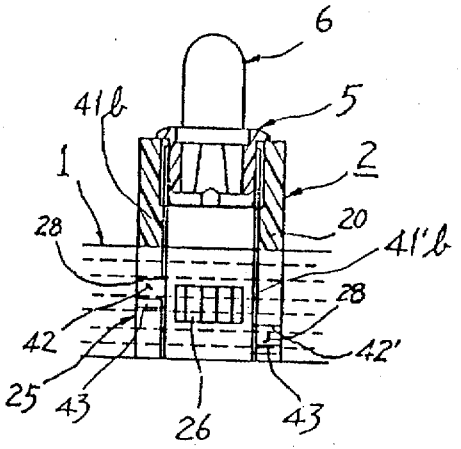
FIG. 4 is a partial enlarged longitudinal sectional view of the first one unit on the left side of FIG. 3.

The main seat 2 is a reverse L-shaped seat body 20 whereon a cylindrical pit 21 is at the center on the top side for installing a lamp seat 5, a lateral flat U-shaped concave edge 22 passing through the seat body 20 is on each inner wall on the two sides of cylindrical pit 21 for installing two series or parallel connected conductive pieces 4*a*, 4*b* or 4*c*, a small recess 23 is on each of the front and rear outer walls in the upper part of seat body 20 for installing a reflecting cover 7 (as shown in FIG. 7 and 8); the reverse L-shaped seat body 20 is essentially designed to pre-set a space in the position on the front side in the lower part of seat body 20 for installing a fixing plate 3, so that a dovetail slot 24 can be installed on the upper edge of said space, and an "arrowhead" shaped snap pillar 26 able to expand and contract left and right is at the crater on a vertical plate 25 on the rear side of said space for snapping the fixing plate 3; snapping the fixing plate 3 on the main seat 2 is essentially desired to install the the flat electric wire 1 to assemble two series or paralled connected conductive pieces 4*a*, 4*b* or 4*c* and the main seat 2, so that two longitudinal recesses 27 leading to the lateral flat U-shaped concave edge 22 are pre-set on the left and right sides of vertical plate 25 on the rear side in the lower part of main seat body 20 in favor of insterting two series or parallel connected conductive pieces 4*a*, 4*b* or 4*c* and installing two or three lateral recesses 28 and one or two lateral flanges 29 therein so as to catch two series or parallel connected conductive pieces 4*a*, 4*b* or 4*c* (as shown in FIG. 3 and 4) so that these conductive pieces 4*a*, 4*b* or 4*c* will never move up and down.

The fixing plate 3 is a plate body 30 with a square hole 31 at the center and an upward dovetail tenon 32 on the top side to be inserted in the dovetail slot 24 on the main seat body 20, the arrowhead shaped snap pillar 26 on the seat body 20 is inserted in the said square hole 31 at the center of the fixing plate body 30, so that the fixing plate 3, the flat electric wire 1 and two series or parallel connected conductive pieces 4*a*, 4*b* or 4*c*are fixed on and assembled with the main seat 2; a F-shaped fixing piece 33 on one side on the lower edge of the fixing plate body 30 is used as a lug for fixing or locking during the installation of the present invention.

Each set of series connected conductive piece 4*a* and each set of the first and the second parallel connected conductive pieces 4*b*, 4*c* comprise a pair of left and right conductive piecee 41*a*, 41'*a*; 41*b*, 41'*b* and 41*c*, 41'*c*respectively, each left or right conductive piece is a lateral Z-shaped plate body 40 of which the lower end is folded into a positioning piece 42, 42' toward left or right side respectively and then folded into a horizontal tooth 43 toward the front side, so that through two lateral Z-shaped plate bodies 40, a conductive piece is inserted into each of the lateral flat U-shaped concave edges on the two sides of the cylindrical pit 21 on the main seat body 20, and through the positioning pieces 42, 42', a conductive piece is caught in a lateral recess 28 on the vertical plate 25 on the lower side of main seat body 20 (as shown in FIG. 4), and when the conductive piece is caught by the fixing plate 3, the horizontal sharp tooth 43 is thrust into the middle strand series connected conductor 11 or the upper and lower strand parallel connected conductors 12, 13 of the electric wire 1 (as shown in FIG. 3 and 4) to be connected to one or two strand conductors of the electric wire 1; since the distances between the centers of each strand conductors 11, 12 and 13 of the electric wire 11 and the upper edge of the electric wire body 10 differ from each other, and the left and right conductive pieces 41*a*, 41'*a* of series connected conductive piece 4*a* are simultaneously inserted into the middle strand series connected conductor 11, so two conductive pieces with same middle length may be made; the left and right conductive pieces 41*b*, 41'*b* of the first parallel connected conductive piece 4*b* are respectively inserted into the upper strand parallel connected conductor 12 and the middle strand series connected conductor 11, so one each conductive piece with a short length and a middle length can be made respectively for parallel connection with the upper and middle strand conductors 12, 11; and the left and right conductive pieces 41*c*, 41'*c* of the second parallel connected conductive piece 4*c* are respectively made to have a middle length and a long length for parallel connection with the middle and lower strand conductors 11, 13.

The lamp seat 5 has a seat body 50 in the shape of a reverse top hat with a central cylindrical pit 51 of which the upper edge is a step joint 52 with a larger diameter for installing a bulb 6, and two openings or through holes 53 on the two sides on the bottom of the said pit 51 are designed to let two conductive legs of bulb 6 on the upper edge of the said pit 51 pass through therefrom.

Figure 6:
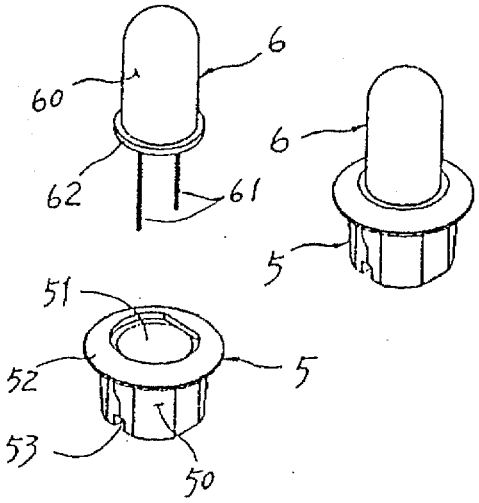
FIG. 6 shows a partial elevational view and an elevational breakdown view of lamp seat and bulb of the present invention.

The bulb 6 has a bulb body 60 of which the lower end is a tungsten filament with two conductive legs 61 or a LED, a step cut ring 62 is on the outer edge of the said lower end to engage with the step joint 52 on the upper edge of the said pit 51 on the lamp seat body 50; after the bulb 6 is installed on the step joint 52, the two conductive legs 61 passing thru the openings or through holes 53 on the two sides at the bottom of lamp seat body 50 are folded upward to contact the two outer walls of the lamp seat body 50 (as shown in the state of FIG. 5 and the right side of FIG. 6) so as to be combined as one body to be inserted into the said pit 21 on the main seat body 20, so that the two conductive legs 61 can contact the upper end of lateral Z-shaped plate body 40 of two series or parallel connected conductive pieces 4*a*, 4*b* or 4*c* which have been connected to one or two strand conductors of the flat electric wire 1 which supplies power to light the bulb 6.

Figure 2:
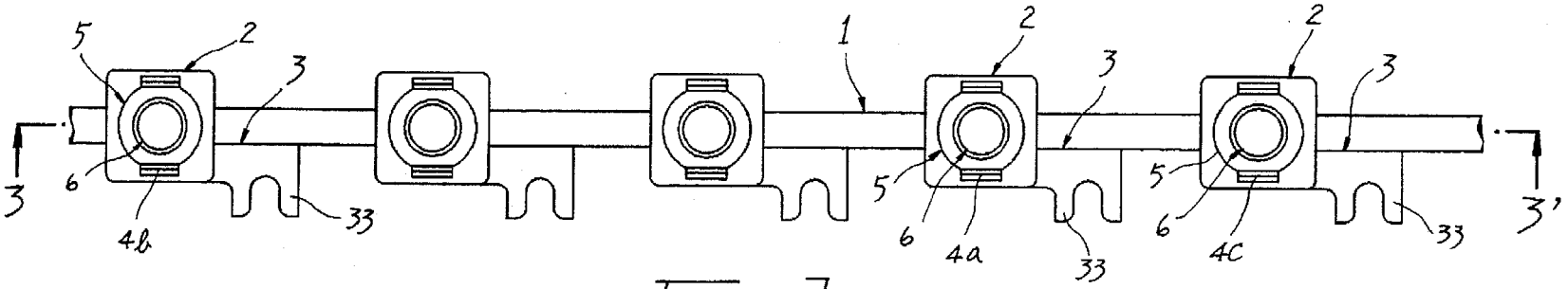
FIG. 2 is a top view of the present invention.

Regardless of using which one set of series or parallel connected conductive piece 4*a*, 4*b* or 4*c*, when to install and assemble an improved lamp strip according to the present invention as shown in FIG. 1 and 2, the combination and assembly thereof is the same in the following sequence: the two lateral Z-shaped plate bodies 40 of each set of series or parallel connected conductive piece 4*a*, 4*b* or 4*c* (as shown in FIG. 5) are inserted into the lateral flat U-shaped concave edges 22 on the two sides of the said pit 21 on the main seat body 20, the positioning pieces 42, 42' thereof are caught in the lateral recesses 28 on the vertical plate 25 on the lower side of the main seat body 20 (as shown in the state of FIG. 4); then to let the "arrowhead" shaped snap pillar 26 at the center of vertical plate 25 pass through one square hole 14 on the flat electric wire body 10, and to snap a fixing plate 3 on the "arrowhead" shaped snap pillar 26; and finally, to insert the lamp seat 5 directly into the cylindrical pit 21 at the center on the top side of main seat body 20 after a bulb 6 is attached to the lamp seat 5 and the two conductive legs 61 of the bulb 6 are folded upward to contact the two outer side walls of the lamp seat 5, the combination and assembly of the present invention are thus finished in a quite simple and quick manner manually and directly not in need of any machine or tool. The assembled decorative lamp strip of the present invention can be fixed or locked in a position of installation for use through a F-shaped fixing piece 33 extending from one side on the lower edge of the fixing plate body 30, or the F-shaped fixing piece 33 may be cut off and replaced with a fixing device in general for fixing an electric wire 1. If the user or consumer would like to have a brighter bulb 6 or a farther illuminating distance, a reflecting cover 7 may be directly installed on two small recesses 23 on the main seat body 20 (as shown in FIG. 7 and 8), or during the combination and assembly, to install the reflecting cover 7 on the main seat body 2 and then to install a lamp seat 5 and a bulb 6. In order to conveniently install the reflecting cover 7 on the two recesses 23 on the main seat body 20, a pair of opposite L-shaped hooky pieces 71 may be provided to the two sides on the lower edge of cover body (as shown in FIG. 5, 7 and 8).

Figure 9:
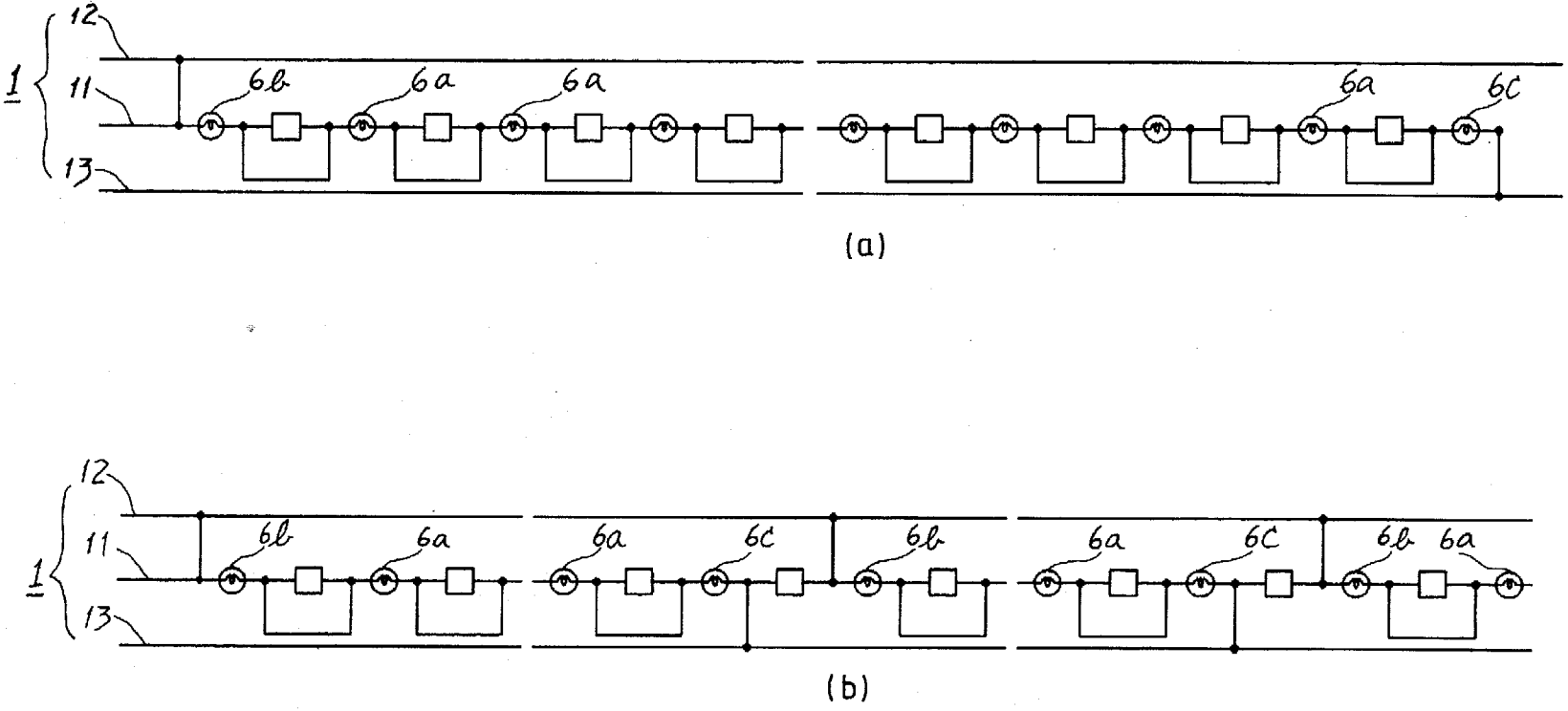
FIG. 9 is a schema of series and parallel connected circuits of the present invention.

As shown in the series and parallel connected circuit diagrams (a) and (b) of FIG. 9, if the applied voltage value of bulb 6 is the same as that of upper and lower strand parallel conductors 12, 13 of the flat electric wire 1, the main seat body 20 for installing each bulb 6*a* is the main seat 2 for installing a set of series connected conductive piece 4*a* (as shown in FIG. 5), only the foremost one bulb 6*b* and the last one bulb 6*c* are mounted respectively on the main seat 2 of a set of the first and the second parallel connected conductive pieces 4*b*, 4*c*. If the voltage value of the flat electric wire 1 is more than twice of that of the bulb 6, to wit, if the applied voltage value of bulb 6 is 3 V or 6 V, but that of the electric wire 1 is 12 V, 24 V or even 110 V or 220 V, it is necessary to have a set of each 2, 4 or 8 bulbs 6 or 19, 37 or 74 bulb 6 respectively and to use the main seat body 20 of the foremost on bulb 6*b* and the last one bulb 6*c* of each set as a unit and as the main seat for a set of the first and second parallel connected conductive pieces 4*b*, 4*c*, wherein each bulb 6*a* can be installed on the main seat 2 for a set of series connected conductive piece 4*a*, so the user can quite conveniently adjust the combination thereof on his own.

I claim:

1. A decorative lamp strip, comprising:

a. a flat electric wire, comprising:

i. a middle strand conductor for series connection, ii. an upper strand conductor for parallel connection, and iii. a lower strand conductor, also for parallel connection;

a plurality of square holes on an electric wire body for installing each main seat;

b. each of the main seat having a L-shaped seat body thereof for installing a main seat in the position of each square hole on the flat electric wire, each main seat comprising:

i. a cylindrical pit at the center on the upper side of main seat, ii. two lateral U-shaped concave edges on the inner wall on the two sides of the cylindrical pit and along the length of said inner walls, iii. a dovetail slot on the front bottom side of the main seat, and iv. a set of "arrowhead" shaped snap pillar at the center of vertical plate on the lower side of the main seat body;

c. each fixing plate for installing the main seat on the flat electric wire, each fixing plate comprising:

i. a plate body with an upward dovetail tenon, and ii. a square hole at the center of the plate body;

to insert the dovetail tenon into the dovetail slot and to insert a set of "arrowhead" shaped snap pillar into the square holes so as to fix the main seat in the position of square holes on the flat electric wire;

d. a set of series connected conductive piece or a set of a first and a second parallel connected conductive pieces, each set thereof comprising:

i. a left conductive piece as a lateral Z-shaped plate body of which the lower end is folded into a vertical positioning piece toward left side and then folded into two horizontal sharp teeth toward front side, and the upper end is inserted into a lateral U-shaped concave edge on the left side of cylindrical pit on the main seat, and ii. a right conductive piece as a lateral Z-shaped plate body of which the lower end is folded into a vertical positioning piece toward right side and then folded into two horizontal sharp teeth toward front side, and the upper end is inserted into a lateral U-shaped concave edge on the right side of cylindrical pit on the main seat;

e. each lamp seat as a seat body in the shape of a reverse top hat, comprising:

i. a central cylindrical pit for installing a bulb, and ii. two openings on the two sides at the bottom of seat body and leading to the cylindrical pit;

to insert a bulb into the cylindrical pit on the lamp seat which is then inserted into the cylindrical pit on the main seat; and f. each bulb with two conductive legs at lower end to be inserted into the cylindrical pit on the lamp seat, wherein these two conductive legs respectively pass through the two openings at the bottom of lamp seat body and then to be folded upward to contact the two outer side walls of the lamp seat body;

therefore, to install each main seat in the position of each square hole on the flat electric wire, to insert a set of "arrowhead" shaped snap pillar on the main seat into the square hole, to install a fixing plate on the said set of "arrowhead" shaped snap pillar, to thrust the two horizontal sharp teeth of each set of series connected or parallel connected conductive piece into the middle or upper and lower strand conductors of the flat electric wire, and to insert the lamp seat with a bulb into the cylindrical pit on each main seat, then the said decorative lamp strip is well combined.

2. A decorative lamp strip as claimed in claim 1, wherein the main seat further comprises two small recesses on the front and rear outer walls in the upper part of main seat body, and a reflecting cover with a pair of reverse L-shaped hooky pieces on the two sides on the lower edge of the reflecting cover body to be inserted into the small recesses.

3. A decorative lamp strip as claimed in claim 1 further comprising:

two longitudinal recesses on a vertical plate on the lower side of each main seat and leading to the lateral U-shaped concave edges on the two sides of each main seat body; and two or three lateral recesses and one or two lateral flanges on the vertical plate on the lower side of each main seat for positioning and installing two series connected conductive pieces or parallel connected conductive pieces.

4. A decorative lamp strip as claimed in claim 1 further comprises a F-shaped fixing piece on the lower edge of the fixing plate to be used as a lug for installation.

5. A decorative lamp strip as claimed in claim 1, wherein the left and right condtuctive pieces of each set of series connected conductive pieces are designed to have a middle length; the left and right conductive pieces of the first parallel connected conductive piece are designed to have a short length and a middle length, and the left and right conductive pieces of the second parallel connected conductive piece are designed to have a middle length and a longer length.

* * * * *